US008388172B2

(12) United States Patent
Yue et al.

(10) Patent No.: US 8,388,172 B2
(45) Date of Patent: Mar. 5, 2013

(54) LED LAMP

(75) Inventors: Jun Yue, Shenzhen (CN); Huai-Shan Gu, Shenzhen (CN); Ting Dong, Shenzhen (CN); Fu-Bo Gong, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 41 days.

(21) Appl. No.: 13/070,487

(22) Filed: Mar. 24, 2011

(65) Prior Publication Data

US 2012/0051038 A1 Mar. 1, 2012

(30) Foreign Application Priority Data

Aug. 25, 2010 (CN) ..... 2010 1 0262450

(51) Int. Cl.
*F21S 4/00* (2006.01)

(52) U.S. Cl. ..... 362/219; 362/249.02; 362/294

(58) Field of Classification Search ..... 362/217.01, 362/217.02, 217.1, 217.11–217.14, 218, 362/219, 222–224, 225, 227, 249.01, 249.02, 362/260, 294, 311.01, 311.02, 373, 555; 313/317, 318.01, 318.02, 498–500, 512
See application file for complete search history.

(56) References Cited

U.S. PATENT DOCUMENTS

| | | | | |
|---|---|---|---|---|
| 7,594,738 | B1 * | 9/2009 | Lin et al. | 362/249.02 |
| 7,611,260 | B1 * | 11/2009 | Lin et al. | 362/224 |
| 7,997,770 | B1 * | 8/2011 | Meurer | 362/311.02 |
| 8,147,091 | B2 * | 4/2012 | Hsia et al. | 362/221 |
| 2010/0033964 | A1 * | 2/2010 | Choi et al. | 362/234 |
| 2010/0201239 | A1 * | 8/2010 | Mostoller et al. | 313/1 |
| 2010/0290218 | A1 * | 11/2010 | Yang et al. | 362/223 |
| 2011/0084554 | A1 * | 4/2011 | Tian et al. | 307/66 |
| 2011/0090682 | A1 * | 4/2011 | Zheng et al. | 362/218 |

FOREIGN PATENT DOCUMENTS

| | | |
|---|---|---|
| CN | 201517759 U | 6/2010 |
| TW | M379014 U1 | 4/2010 |
| TW | M386440 U1 | 8/2010 |

* cited by examiner

*Primary Examiner* — Hargobind S Sawhney
(74) *Attorney, Agent, or Firm* — Altis Law Group, Inc.

(57) ABSTRACT

An LED lamp includes a cylindrical tube and two lamp holders fixed on two ends of the cylindrical tube. The cylindrical tube comprises a lampshade, a lamp plate, and a heat dispersing plate. The heat dispersing plate further comprises a base portion and two fastening portions. Two free edges of the base portion comprise two supports extending toward each other. The fastening portions are connected to the supports correspondingly, and the lamp shape and the lamp plate are fixed to the fastening portions correspondingly. Two lamp holders are fixed to opposite ends of the cylindrical tube, and each of the lamp holders comprises a hollow shell and a protrusion formed on an inner wall of the hollow shell. The protrusion resists against one end of the supports to prevent the lampshade from rotating relative to the heat dispersing plate.

17 Claims, 5 Drawing Sheets

LED LAMP

BACKGROUND

1. Technical Field

The present disclosure relates to LED lamps, especially to an LED lamp that can be assembled rapidly.

2. Description of Related Art

Typically, an LED lamp includes a tube and two lamp holders. When an LED lamp is assembled, it is difficult for operators to align screw holders of the two lamp holders and the tube to fix the lamp holders on the tube, thus reducing efficiency in assembling. Therefore an LED lamp that can be assembled rapidly is needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
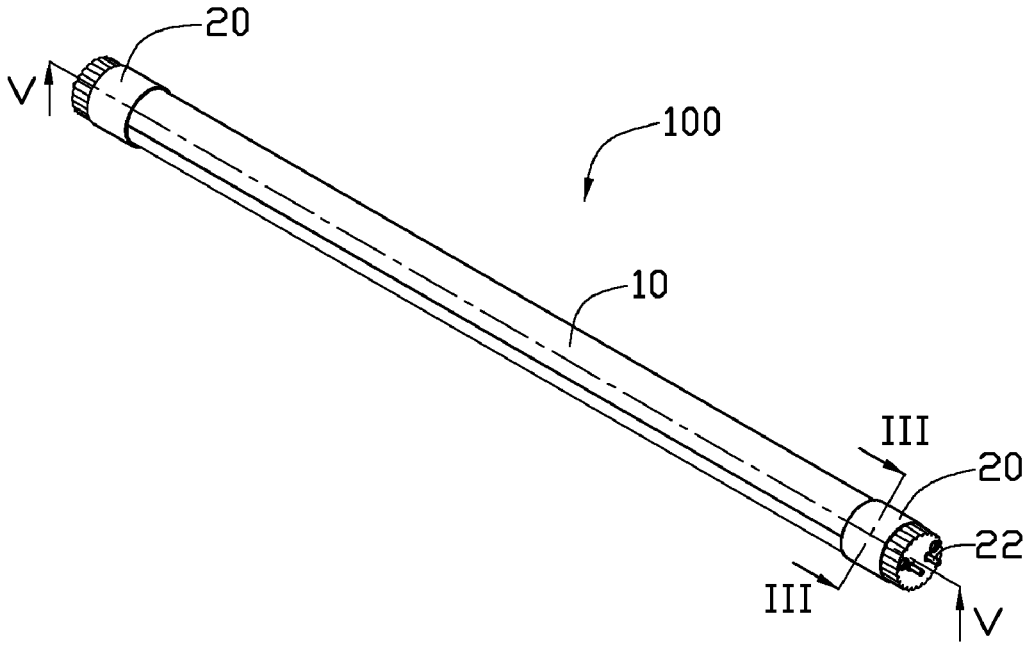
FIG. 1 is an isometric view of an LED lamp according to an exemplary embodiment.

Referring to FIG. 1, an LED lamp 100 includes a cylindrical tube 10 and two lamp holders 20 fixed at two ends of the cylindrical tube 10. The LED lamp 100 can be fixed to and electrically connected to a light tube holder (not shown) via contact pins 22 protruding from ends of the lamp holders 20.

Figure 2:
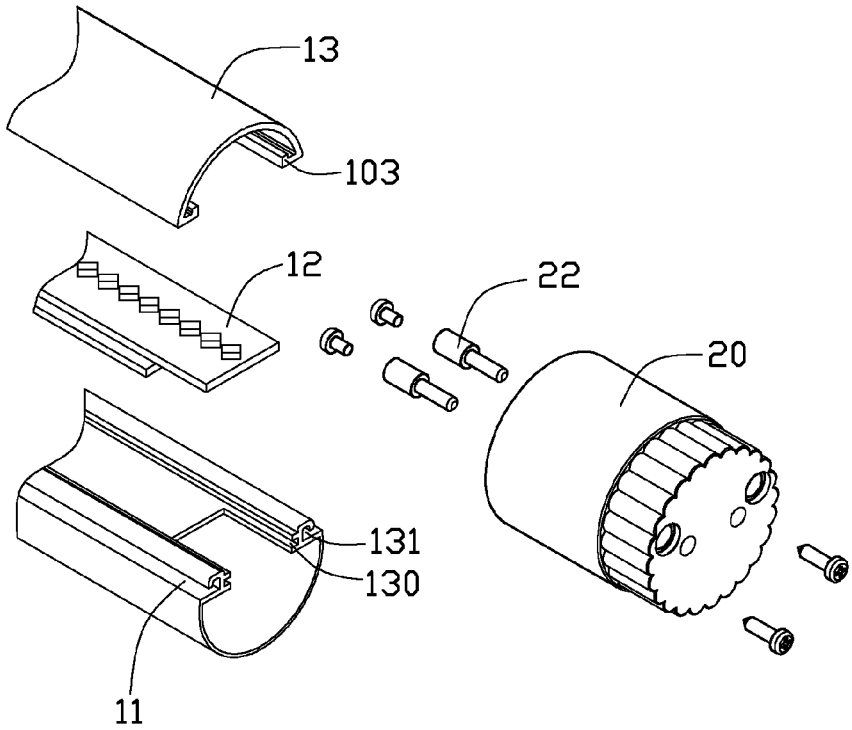
FIG. 2 is a partial, exploded view of the LED lamp of FIG. 1.

Referring to FIG. 2, the cylindrical tube 10 includes a heat dispersing plate 11, a lamp plate 12, and a lampshade 13. The heat dispersing plate 11 and the lampshade 13 are both half-cylindrical in shape and cooperatively form the cylindrical tube 10. In the embodiment, the heat dispersing plate 11 is made of heat dispersing material with good heat conductivity, such as aluminium alloy plating. A number of LEDs are arranged on the lamp plate 12, and each LED is electrically connected to the contact pins 22 of the lamp holders 20. The lampshade 13 is substantially semi-circular in cross-section and is made of transparent fire-resistant material. The lamp plate 12 and the lampshade 13 are both mounted to the heat dispersing plate 11.

Figure 3:
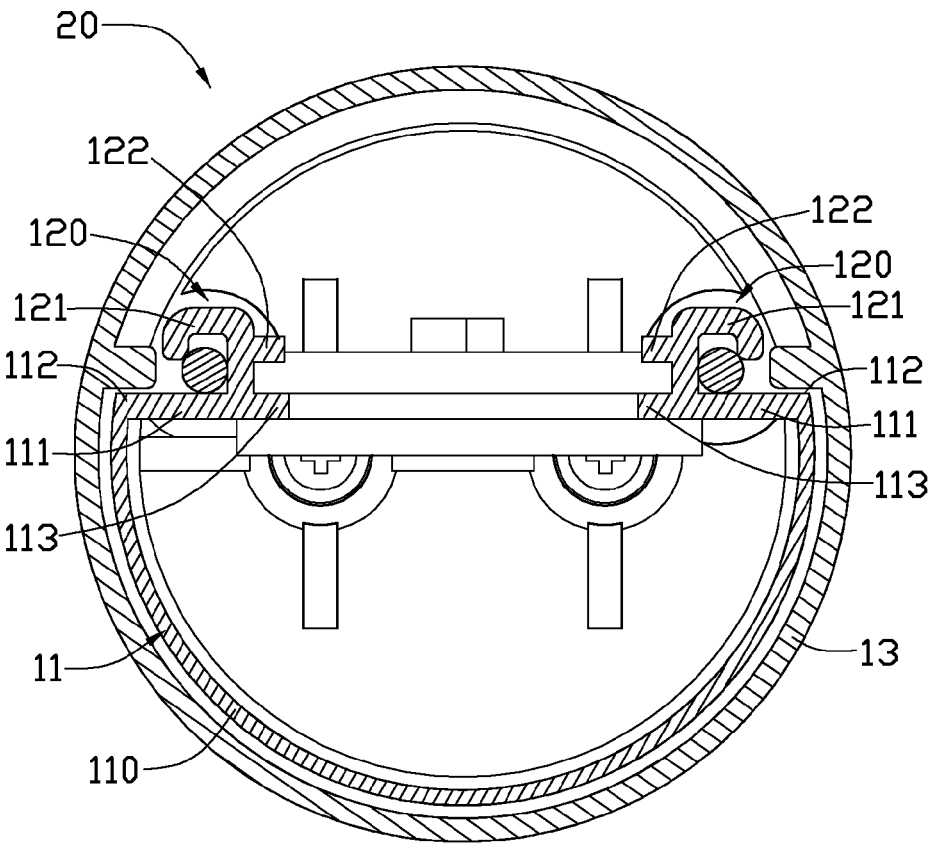
FIG. 3 is a cross-sectional view taken along line III-III of FIG. 1.

Referring to FIG. 3, the heat dispersing plate 11 includes a base portion 110 and two fastening portions 120. The base portion 110 may be integrally formed with the two fastening portions 120. In the embodiment, the base portion 110 is substantially semi-circular in cross-section, and can mate with the lampshade 13 to form a cylindrical tube 10. Two spaced supports 111 extend in from opposite free edges of the base portion 110. Each fastening portion 120 protrudes up from a support 111 and includes a latching member 121 and a positioning protrusion 122. Each latching member 121 may be an L-shaped hook perpendicular to the support 111. A first groove 131 is formed at the back side of each fastening portion 120. The free end of the L-shaped hook faces a first end 112 of the support 111. The positioning protrusion 122 is substantially perpendicular to a sidewall of the latching member 121 and extends away from the first end 112. The free end of the positioning protrusion 122 is substantially coplanar with a second end 113 of the support 111. A second groove 130 is formed between the positioning protrusion 122 and the support 111. Opposite edges of the lamp plate 12 are received in the second groove 130.

Two engaging members 103 protrude in from opposite edges of the lampshade 13 and are respectively received in the first groove 131 to fix the lampshade 13 to the heat dispersing plate 11.

Figure 4:
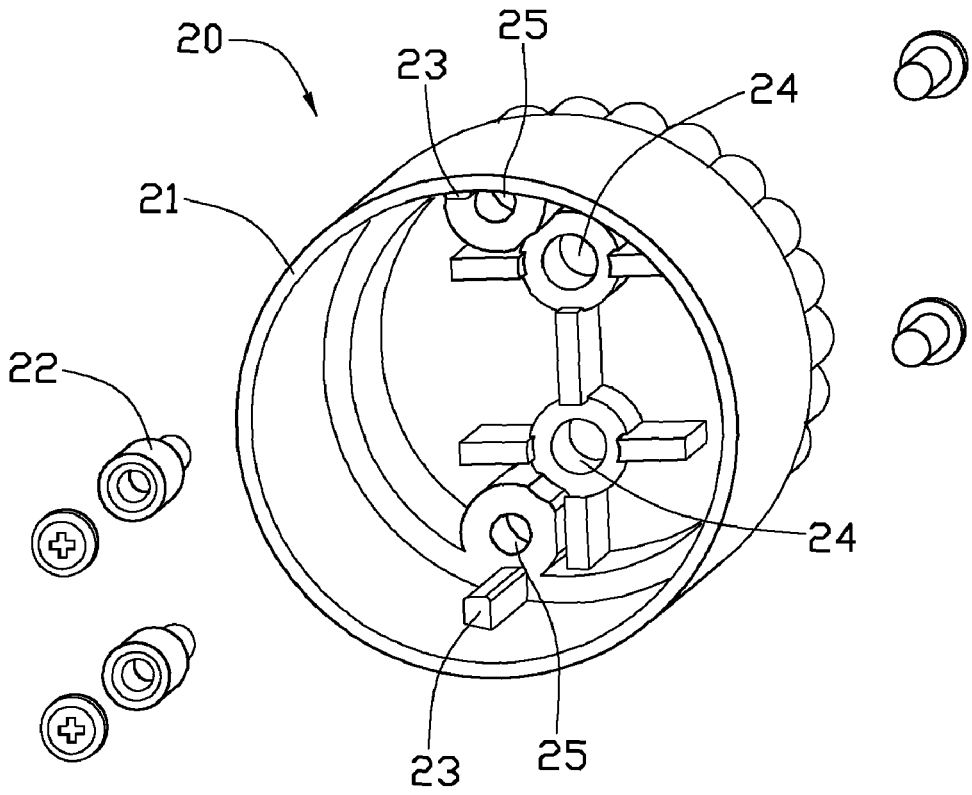
FIG. 4 is an isometric view of a lamp holder of the LED lamp of FIG. 1.
Figure 5:
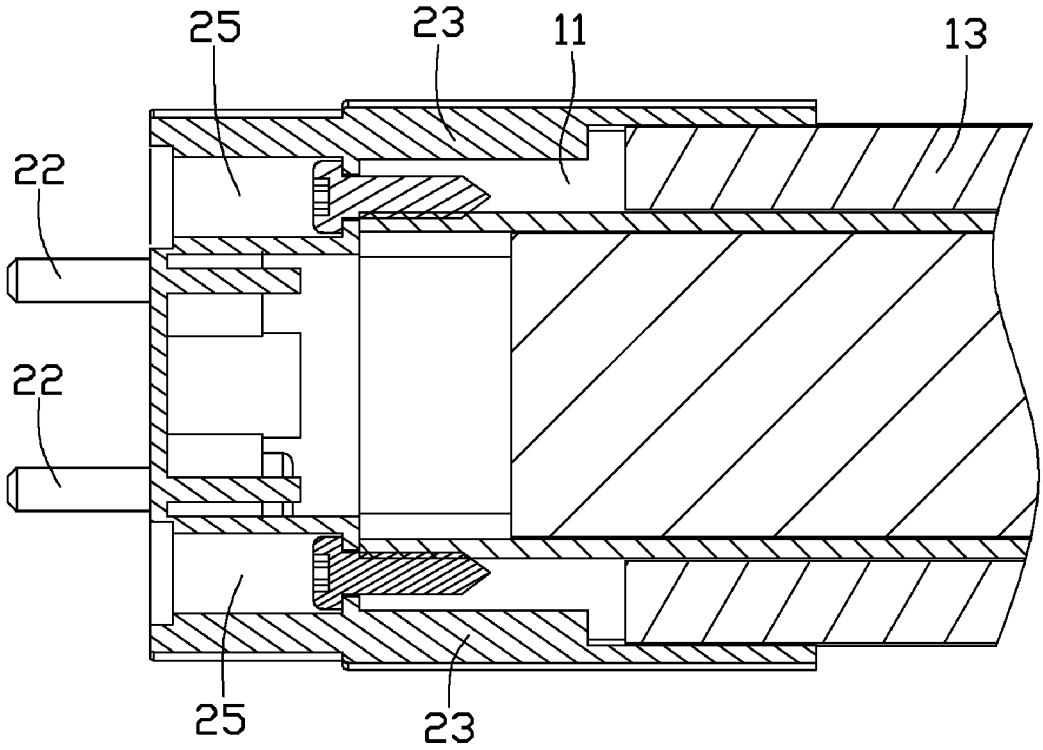
FIG. 5 is a partial, cross-sectional view taken along line V-V of FIG. 1.

Referring to FIGS. 4 and 5, each lamp holder 20 includes a hollow shell 21, two contact pins 22, and two protrusions 23. In the embodiment, the lamp holder 20 is cylindrical for engaging the cylindrical tube 10. The bottom of the hollow shell 21 defines two alignment holes 25 and two screw holes 24. When assembling the LED lamp 100, the two alignment holes 25 are aligned with the first grooves 131 of the heat dispersing plate 11. Screws are then extended through the alignment holes 25 and screwed into the first grooves 131, fixing the hollow shell 21 to the heat dispersing plate 11. In the embodiment, the diameter of the screws is greater than the size of the first grooves 131 for interferingly fixing the screws to the first grooves 131. Each contact pin 22 extends out of the hollow shell 21 and can be fixed to the hollow shell 21 by screws. In the embodiment, two columnar protrusions 23 are formed on the inner wall of the hollow shell 21 adjacent to the alignment holes 25 for resisting against the first end 112 of the support 111, to prevent the lamp shape 13 from sliding in the first grooves 131 and rotating relative to the heat dispersing plate 11. With such structure, the lamp holders 20 can be quickly fixed to the heat dispersing plate 11.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED lamp comprising:

a hollow tube comprising a lampshade, a lamp plate and a heat dispersing plate; the heat dispersing plate comprising a base portion and two fastening portions, two free edges of the base portion comprising two supports extending toward each other, the fastening portions being respectively connected to the supports, the lampshade and the lamp plate being mounted to the fastening portions;

two lamp holders fixed to opposite ends of the cylindrical tube, each of the two lamp holders comprising a hollow shell and at least one protrusion formed on an inner wall of the hollow shell, the at least one protrusion resisting against one end of the supports to prevent the lampshade from rotating relative to the heat dispersing plate;

wherein the bottom of the hollow shell defines a plurality of alignment holes and screw holes, when assembling the LED lamp, the alignment holes are aligned with the first grooves of the heat dispersing plate to fix the hollow shell to the heat dispersing plate.

2. The LED lamp of claim 1, wherein each of the fastening portions extends upwardly from one of the supports, and comprises a latching member and a positioning protrusion; each latching member that is perpendicular to the support extends upwardly to form a first groove; the positioning protrusion that is perpendicular to a sidewall of the latching member; a second groove is formed between the positioning protrusion and the support to receive the lamp plate.

3. The LED lamp of claim 2, wherein each latching member is an L-shaped hook perpendicular to the support, the free end of the L-shaped hook is defined at the inside of a first end of the support.

4. The LED lamp of claim 2, wherein the positioning protrusion perpendicular to a sidewall of the latching member extends along opposite to the first end of the support.

5. The LED lamp of claim 2, wherein a free end of the positioning protrusion is substantially coplanar with a second end of the support.

6. The LED lamp of claim 1, wherein opposite ends of the lampshade each comprise two protrusions opposite to each other engaged in the first groove to fix the lamp shape on the heat dispersing plate.

7. The LED lamp of claim 1, wherein the base portion is integrally formed with the fastening portions.

8. The LED lamp of claim 1, wherein the length of two supports is smaller than the radius of the base portion.

9. The LED lamp of claim 1, wherein each of the lamp holders further comprises two contact pins, each of contact pins extends out of the hollow shell and is fixed to the hollow shell.

10. The LED lamp of claim 1, wherein the heat dispersing plate is made of aluminium alloy material.

11. The LED lamp of claim 1, wherein the lampshade is semi-circular and is made of transparent fire-resistant material.

12. An LED lamp comprising:

a hollow tube comprising a lampshade, a lamp plate and a heat dispersing plate; the heat dispersing plate comprising a base portion and two fastening portions, two free edges of the base portion comprising two supports extending toward each other, the fastening portions being respectively connected to the supports, the lampshade and the lamp plate being mounted to the fastening portions; wherein each of the fastening portions extends upwardly from one of the supports, and comprises a latching member; each latching member that is perpendicular to the support extends upwardly to form a first groove for fixing the lamp shape on the heat dispersing plate;

two lamp holders fixed to opposite ends of the cylindrical tube, each of the two lamp holders comprising a hollow shell;

wherein the bottom of the hollow shell defines a plurality of alignment holes, when assembling the LED lamp, the alignment holes are aligned with the first grooves of the heat dispersing plate for allowing screws extended through the alignment holes and screwed into the first grooves to fix the hollow shell to the heat dispersing plate.

13. The LED lamp of claim 12, wherein at least one protrusion is formed on an inner wall of the hollow shell, the at least one protrusion resisting against one end of the supports to prevent the lampshade from sliding on the heat dispersing plate and rotating relative to the heat dispersing plate.

14. The LED lamp of claim 12, wherein each latching member is an L-shaped hook perpendicular to the support, and the free end of the L-shaped hook is defined at the inside of a first end of the support.

15. The LED lamp of claim 12, wherein each of the fastening portions further comprises a positioning protrusion; the positioning protrusion that is perpendicular to a sidewall of the latching member; and a second groove is formed between the positioning protrusion and the support to receive the lamp plate.

16. The LED lamp of claim 15, wherein the positioning protrusion perpendicular to a sidewall of the latching member extends along opposite to the first end of the support.

17. The LED lamp of claim 12, wherein opposite ends of the lampshade each comprise two protrusions opposite to each other engaged in the first groove to fix the lamp shape on the heat dispersing plate.

* * * * *